US009873009B2

(12) United States Patent
Miller

(10) Patent No.: US 9,873,009 B2
(45) Date of Patent: Jan. 23, 2018

(54) TRAMPOLINE ENCLOSURE WITH A SELF CLOSING DOOR

(71) Applicant: BOARD & BATTEN INTERNATIONAL INC., Georgetown, BWI (KY)

(72) Inventor: David Jethro Miller, Christchurch (NZ)

(73) Assignee: BOARD & BATTEN INTERNATIONAL INC., Georgetown (KY)

( * ) Notice: Subject to any disclaimer, the term of this patent is extended or adjusted under 35 U.S.C. 154(b) by 0 days.

(21) Appl. No.: 15/290,487

(22) Filed: Oct. 11, 2016

(65) Prior Publication Data

US 2017/0095685 A1 Apr. 6, 2017

Related U.S. Application Data

(63) Continuation of application No. 14/119,287, filed as application No. PCT/NZ2012/000071 on May 23, 2012, now abandoned.

(Continued)

(51) Int. Cl.

| | |
|---|---|
| ***A63B 5/11*** | (2006.01) |
| ***A63B 71/00*** | (2006.01) |
| ***A63B 71/02*** | (2006.01) |

(52) U.S. Cl.

CPC ..... *A63B 5/11* (2013.01); *A63B 71/0054* (2013.01); *A63B 71/022* (2013.01); *A63B 2209/02* (2013.01); *A63B 2210/54* (2013.01)

(58) Field of Classification Search

CPC .... A63B 5/00; A63B 5/11; A63B 5/16; A63B 6/00; A63B 21/00058; A63B 21/00069; A63B 21/00072; A63B 21/00076; A63B 21/00178; A63B 21/00181; A63B 21/00185; A63B 21/002; A63B 21/0023; A63B 21/02; A63B 21/026; A63B 21/04; A63B 21/0407; A63B 21/0414; A63B 21/0421; A63B 21/0428; A63B 21/0435; A63B 21/0442; A63B 21/068; A63B 21/08; A63B 21/15; A63B 21/159; A63B 21/16; A63B 21/1618; A63B 21/1627; A63B 21/1636; A63B 21/1645; A63B 21/1654;

(Continued)

(56) References Cited

U.S. PATENT DOCUMENTS 2,230,454 A * 2/1941 Friesner ..... E04H 15/32 135/117
3,204,649 A * 9/1965 Johnson ..... E04H 15/22 135/117

(Continued)

FOREIGN PATENT DOCUMENTS

| | | |
|---|---|---|
| CA | 2170198 | 8/1997 |
| CN | 1273536 | 11/2000 |
| FR | 2623719 | 6/1989 |

*Primary Examiner* — Andrew S Lo
*Assistant Examiner* — Gary D Urbiel Goldner
(74) *Attorney, Agent, or Firm* — Dann, Dorfman, Herrell and Skillman, P.C.

(57) ABSTRACT

A trampoline enclosure formed from a material such as netting has a door opening for entry into and exit from the trampoline enclosure and a fold down door panel with at least one resilient member acting to bias the door panel to return the door panel to a closed position from a folded down open position.

3 Claims, 8 Drawing Sheets

Related U.S. Application Data

(60) Provisional application No. 61/488,854, filed on May 23, 2011.

(58) Field of Classification Search
CPC ..... A63B 21/1663; A63B 21/1672; A63B 21/1681; A63B 21/169; A63B 21/4023; A63B 21/4027; A63B 21/4033; A63B 21/4034; A63B 21/4035; A63B 21/4037; A63B 21/4045; A63B 21/4047; A63B 21/4049; A63B 26/00; A63B 26/003; A63B 71/0054; A63B 71/02; A63B 71/022; A63B 2071/0063; A63B 2071/0072; A63B 2071/0081; A63B 2071/009; A63B 2209/02; A63B 2209/023; A63B 2209/026; A63B 2209/14; A63B 2210/50; A63B 210/52; A63B 2210/54; A63B 2225/09; A63B 2225/093; A63B 2225/72; A63B 2244/08
See application file for complete search history.

(56) References Cited

U.S. PATENT DOCUMENTS 3,387,412 A * 6/1968 Kwake ..... E04H 15/22 135/115
3,398,483 A * 8/1968 Hablitzel ..... B60J 1/14 49/34
3,744,501 A * 7/1973 Kozarsky ..... E04H 15/20 135/117
D330,742 S * 11/1992 Matsch ..... D21/814
5,487,400 A * 1/1996 Dawkins ..... E04H 15/20 135/124
5,711,743 A * 1/1998 Nichols, Jr. ..... A63B 5/11 135/133
5,722,197 A 3/1998 Albritton
5,941,798 A * 8/1999 Coan ..... A63B 5/11 482/27
6,167,898 B1 * 1/2001 Larga ..... E04H 15/20 135/124
7,047,992 B1 * 5/2006 Fluellen ..... E04H 12/2223 135/136
7,455,069 B2 * 11/2008 Sumner ..... E04H 15/32 135/117
7,481,740 B2 * 1/2009 Colling ..... A63B 5/11 482/27
7,641,594 B2 * 1/2010 Hickey ..... A63B 5/11 239/289
7,678,024 B2 * 3/2010 Alexander ..... A63B 5/11 482/27
D614,715 S * 4/2010 Mann ..... D21/797
7,708,667 B2 * 5/2010 Alexander ..... A63B 5/11 482/27
7,758,471 B2 * 7/2010 Nelson ..... A63B 5/11 482/27
7,854,687 B2 * 12/2010 Alexander ..... A63B 5/11 482/27
7,882,850 B2 * 2/2011 Ball ..... E04H 15/32 135/117
7,883,446 B2 * 2/2011 Lovley, II ..... A63B 5/11 482/27
D653,299 S * 1/2012 Samuel ..... D21/797
8,303,469 B2 * 11/2012 Alexander ..... A63B 5/11 482/27
2003/0064861 A1 * 4/2003 Chen ..... A63B 5/11 482/27
2005/0079954 A1 * 4/2005 Wang ..... A63B 5/11 482/27
2006/0270524 A1 * 11/2006 Colling ..... A63B 5/11 482/27
2006/0270525 A1 * 11/2006 Colling ..... A63B 5/11 482/27
2007/0004560 A1 * 1/2007 Nelson ..... A63B 5/11 482/29
2008/0269019 A1 * 10/2008 Lovley, II ..... A63B 5/11 482/27
2009/0121207 A1 * 5/2009 Bowerman ..... A63B 71/022 256/25
2010/0190608 A1 7/2010 Publicover et al.
2011/0209736 A1 * 9/2011 Ball ..... E04H 15/32 135/117
2011/0256985 A1 * 10/2011 Mann ..... A63B 5/11 482/27

* cited by examiner

TRAMPOLINE ENCLOSURE WITH A SELF CLOSING DOOR

FIELD OF THE INVENTION

The invention relates to a trampoline safety enclosure which has an opening for entry and exit by a user, and which further has a self closing door for the opening in the enclosure, and to a trampoline and safety enclosure in combination.

BACKGROUND

A trampoline in its most basic form generally comprises a rebounding mat fixed to a support frame so that the mat is supported above the ground. A user jumps or otherwise bounces on the mat. A trampoline may be equipped with a safety enclosure, which extends upwards from the mat to surround or enclose the rebounding mat to prevent a user from falling from the trampoline. Usually, the safety enclosure is attached to the trampoline around the edge of, and extends upwards from, the mat. Typically the safety enclosure is formed from mesh or netting. The enclosure is supported in position by a number of poles which extend upwards from around the edge of the trampoline. Usually these poles are connected to the frame.

In order to access the rebounding mat, a user must pass from outside the enclosure to the inside. Usually, the enclosure has an access aperture or slot to facilitate this. In one common form, the two adjacent ends of the enclosure overlap when the enclosure is 'wrapped' around the perimeter of the mat, the overlapping flaps forming a passageway that a user can move through, or which can be opened, to allow access. The adjacent ends are fastened closed by a zip or similar fastener. In another form the edges of the two adjacent ends of the enclosure meet to form a substantially vertical slit in the netting. The slit may be fitted with a zip or similar fastening means to fasten the two edges together and close the slit if desired. A slit opening can also be created by cutting the enclosure.

SUMMARY OF THE INVENTION

It is an object of the invention to provide a trampoline safety enclosure with improved or at least alternative user entry and exit functionality.

In a first aspect the invention may broadly be said to consist in a trampoline system comprising:

a trampoline, having a flexible rebounding mat, a frame, adapted to hold the flexible rebounding mat in tension and aligned in a substantially horizontal plane above the frame, an enclosure formed from a barrier of a flexible material, having a lower peripheral part coupled directly or indirectly to the mat, a plurality of generally upright enclosure support members connected to the frame and extending upwards from the frame around the mat, the enclosure connected to the support members so as to surround the mat above the mat and extend around the mat, the enclosure having, or being connected to the mat so as to form, an opening for ingress and egress, the trampoline system further having a door system comprising:

at least one door panel, sized and shaped to at least partly cover or close the opening, and, at least one resilient member associated with and connecting between the at least one door panel and the trampoline, wherein the at least one resilient member is attached around an edge of the at least one door panel and comprises two ends which are fixed at or below an outer peripheral edge of the mat, so that the opening of the at least one door panel causes bending and unbending of the at least one resilient member, unbending of the at least one resilient member releasing stored spring energy in the at least one resilient member, the at least one door panel movable between an open position allowing ingress and egress, and a closed position where the door panel at least partly covers or closes the opening, the resilient member acting to bias the door panel to the closed position, and to return the door panel to the closed position from the open position.

Preferably the resilient door member is formed from a resiliently elastic material such as a pultruded fibreglass rod.

Preferably the two ends of the rod curve outwards to become substantially parallel to the horizontal plane of the rebounding mat, the ends connected to either the mat or the enclosure or both.

Alternatively the two ends of the rod extend downwards past the base of the door panel and past the edge of the mat to connect to the frame.

Preferably the frame and the rod are adapted so that the two free ends are connected to the frame to point inwards towards the frame, so that the lower part of the main body of the resilient member is bowed outwards away from the mat.

Preferably the resilient door member is formed as a straight rod, the door panel having at least one and preferably a plurality of pockets or loops on or close to the edge of the door, the rod bent and located into the at least one pocket or loop so as to run around the edge of the door panel, or close to the edge of the door panel.

Preferably the base of the door panel is connected to a component of the trampoline.

Even more preferably the door panel is connected to any one, or a combination of, the frame, the mat, or the enclosure.

Preferably the door panel is made from the same material as the mat.

Preferably the opening is substantially circular.

Alternatively the opening is substantially arch-shaped.

Preferably the perimeter of the opening is reinforced with a pultruded fibreglass rod.

Preferably the door panel is opened by pushing or pulling it so that it rotates inwards towards the flexible rebounding mat.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

BRIEF DESCRIPTION OF THE DRAWINGS

Embodiments of the invention are described by way of example with reference to the accompany drawings in which.

DETAILED DESCRIPTION OF PREFERRED EMBODIMENTS

Figure 1A:
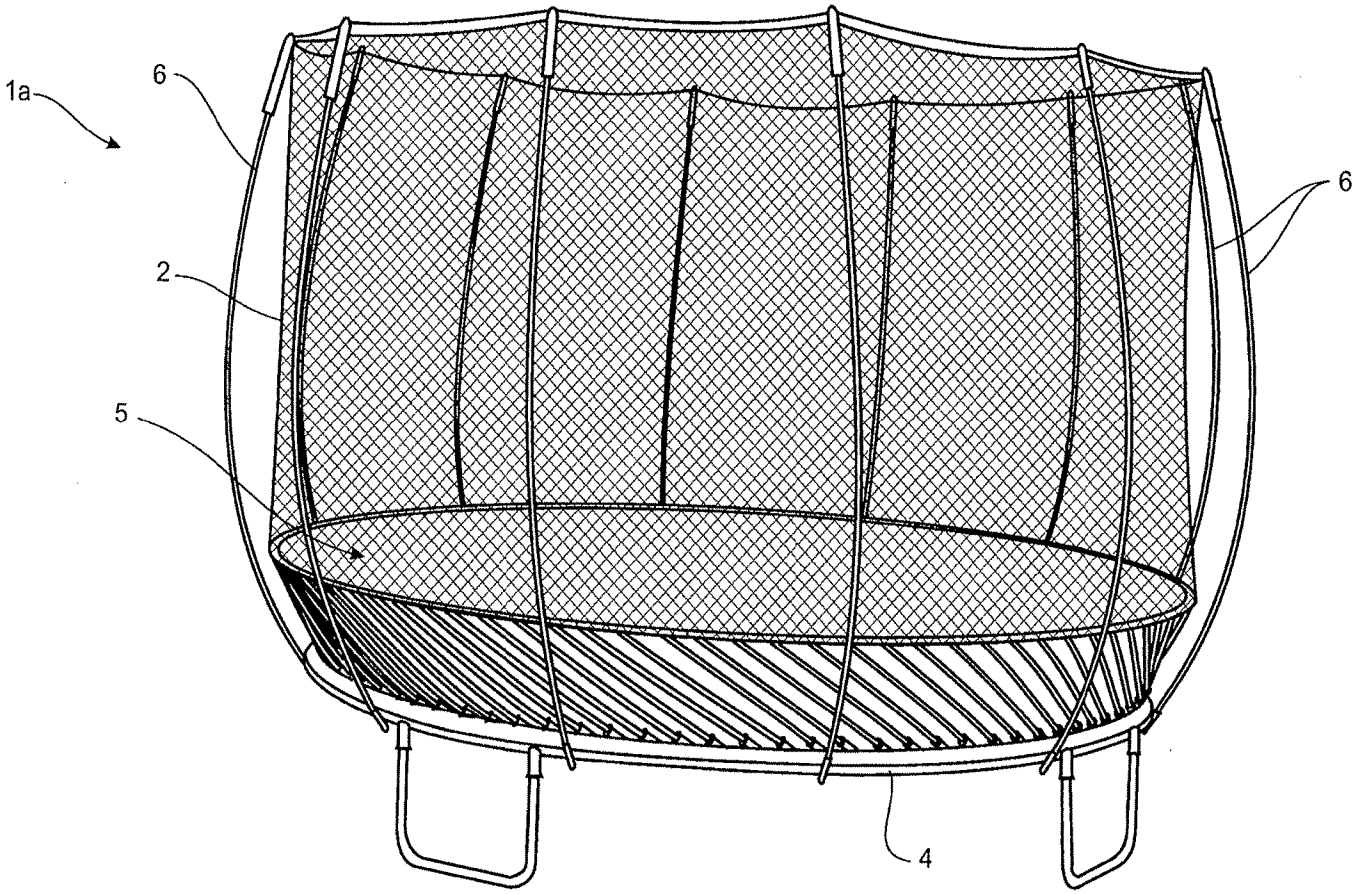
FIG. 1*a* shows a first preferred embodiment of trampoline system, which has a frame, a jumping mat and an enclosure net held above, and surrounding, the jumping mat to form an enclosed jumping area, the frame and jumping mat connected via a number of fiberglass rods extending upwards from the frame to the edge of the mat.
Figure 1B:
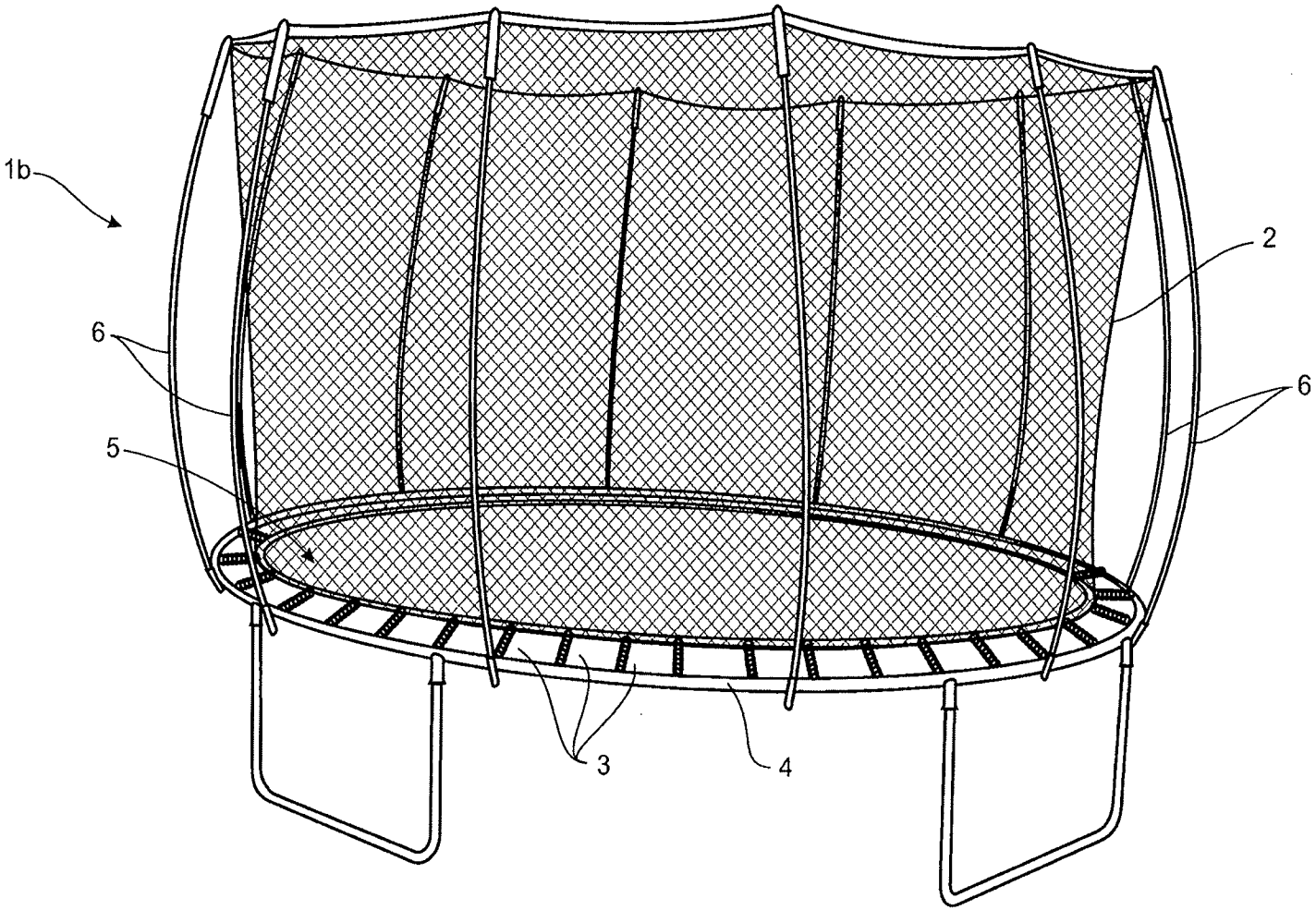
FIG. 1*b* shows a second preferred embodiment of trampoline system, which also has a frame, a jumping mat and an enclosure net held above, and surrounding, the jumping mat to form an enclosed jumping area, the frame and jumping mat connected via a number of springs aligned generally horizontally and extending outwards from the mat to the frame.

FIGS. 1*a* and 1*b* show preferred embodiments of a trampoline system 1. As shown in both FIGS. 1*a* and 1*b*, in each embodiment a trampoline has a frame 4, a rebounding mat 5, and a safety enclosure 2 held in position by a number of enclosure support members or poles 6. The mat 5 is held above the ground in tension and substantially horizontal. The enclosure support members 6 support the enclosure 2 so that the enclosure surrounds and extends upwards from the mat 4 to form an enclosed jumping area. In both embodiment the poles 6 are connected to, and extend upwards from, the frame 4. The enclosures are of a type described in U.S. Pat. Nos. 7,708,672 and 7,854,687 which are hereby incorporated by reference.

In the embodiment shown in FIG. 1*a*, the mat 5 is held in position relative to the frame by a number of flexible rods running from the frame to the edge of the trampoline, with the frame 5 located substantially below the mat 5. Where it would be applicable to do so in this specification, 'frame' should be read as being inclusive of the flexible rods. The trampoline is of a type described in U.S. Pat. Nos. 6,319,174 and 8,105,211 which are hereby incorporated by reference.

In the embodiment shown in FIG. 1*b*, a portion of the frame 4 is generally in the same horizontal plane as the mat 5 and surrounds the perimeter of the mat 5, with a gap between the frame and the mat in which springs 3 extend between the frame 4 and edge of the mat 5. Where it would be applicable to do so in this specification, 'frame' should be read as being inclusive of the springs.

The enclosure 2 is, in the preferred embodiment, formed from netting, such as nylon webbing. An opening or aperture 7 is formed in the enclosure 2 to allow ingress or egress from the jumping area.

Figure 2:
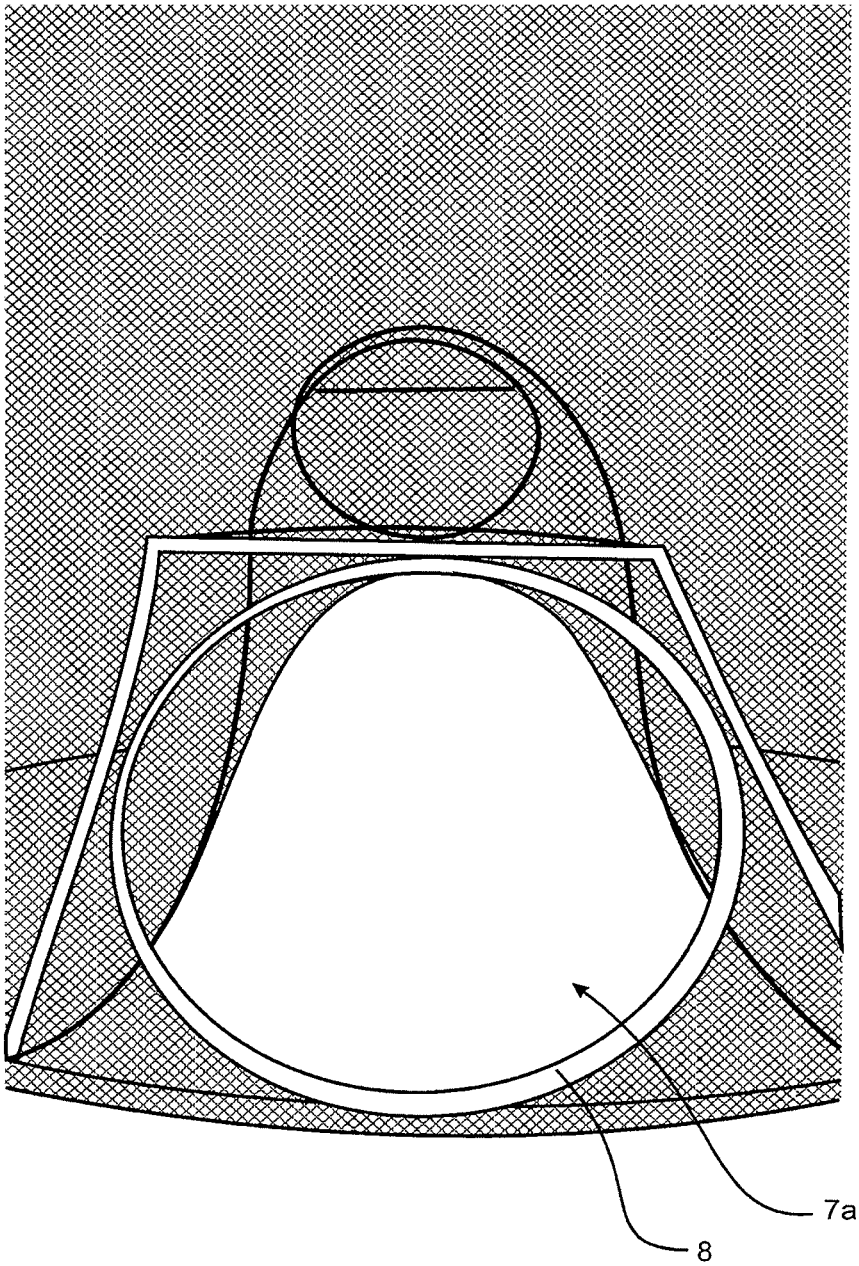
FIG. 2 shows a first preferred form of aperture in the enclosure net, which allows a user to enter and exit the jumping area, the aperture substantially circular and having a reinforced edge.

FIG. 2 shows a first preferred form of aperture 7*a* . A circular hole 7*a* in the enclosure 2 by cutting or similar. The aperture is formed so that the lowest point of the hole 7*a* is just above the surface of the mat. The edge of the aperture 7*a* is reinforced with a surrounding pocket 8, which contains a fibreglass rod or similar to stabilise the hole shape and to hold the aperture 7*a* open. The material that forms the surrounding pocket 8 can also be coloured to help a user easily identify the location of the aperture Alternatively an arch-shaped aperture such as that shown in FIG. 3*a* could be used for example. In the embodiment shown in FIG. 3*a*, the surrounding pocket 8 is arch-shaped, with the two lower ends terminating at the horizontal plane of the mat 5.

The enclosure has a door system for covering and closing the aperture 7*a* when the trampoline system is in use. The door system has two main parts: a door panel, and a self-closing mechanism which biases the door panel into a closed position. When a force is applied to the door to open it or otherwise move it away from a fully closed position, the self-closing mechanism will act on the door to return it to the closed position when the opening force is removed from the door.

Bottom Levered Door

Figure 3A:
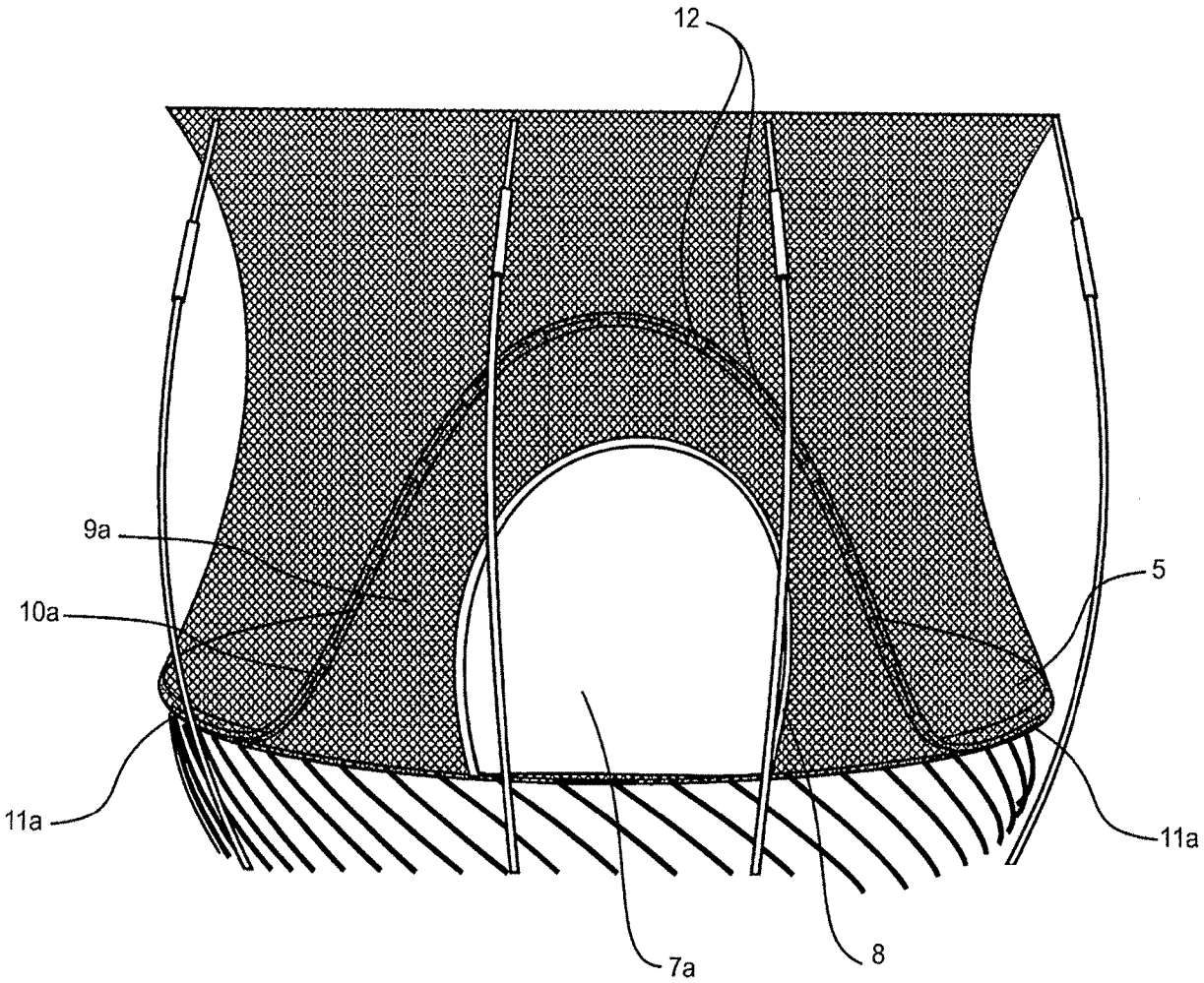
FIG. 3*a* shows a first preferred form of door system for closing an aperture such as the one shown in FIG. 2, the door system having a door panel located on the inside of the enclosure net, which pivots around the lower edge, and a self-closing mechanism around at least part of the edge of the door biasing the door panel towards a closed position.

In the form shown in FIG. 3*a* the door system has a door 9*a* which is a single panel. The door 9*a* has the overall form of a solid arch in the closed position, with the sides flaring or curving outwards away from the side of the arch-shaped aperture (although these could also be straight sided). The sides of the arch rise upwards from the base of the door 9*a* , which is located at or close to the mat 5, and then transition to a curved or rounded top which arches over the top of the door panel. In the preferred form the base of the door panel 9*a* is connected either to the mat or to the enclosure, but could also be connected to the frame, or left unconnected. The door 9*a* is sized and shaped to cover and overlap the circular or arch-shaped opening or aperture 7*a* and is sized and located so as to overlap around the edge of the opening 7*a* . It is most preferred that the door 9*a* is made from the same material as the mat. The door system also has a resilient door member 10*a* , which is connected around the edge of the door 9*a* . In the preferred form, the resilient member 10*a* is a rod, bent or shaped so as to fit around the edge of the arch-shaped door 9*a* , except for the base of the door 9*a* . In the preferred form, the two free ends 11*a* of the resilient member 10*a* extend around the edge of the door, and flare or curve outwards (following the edge of the door) so that the two ends curve to become parallel or nearly parallel to the horizontal plane of the mat 5. In the preferred form, the resilient door member 10*a* is formed from a resiliently elastic material such as a pultruded fibreglass rod, so that it will maintain its shape when no force is applied to it, but if bent away from its natural or rest state by the application of an external force, will return to its original shape when the bending force is removed. The resilient door member 10*a* is, in the preferred form, formed as a straight rod and then bent to connect it to the edge of the door 9*a* via a single pocket or loop along the edge of the door, or via a number of pockets or loops 12 attached to and spaced around the edge, or close to the edge, of the door 9*a*. It should be noted that in this context, 'connected' and 'attached' should be taken to mean either removably attached or connected, or permanently attached or connected. As outlined above, the pockets or loops 12 could be a single pocket extending partly or fully around the edge, or close to the edge, of the door, or a number of pockets or loops spaced around the edge of the door. Alternatively, the door member 10*a* could be initially formed as an arch shape or part arch shape.

When a user wishes to enter or exit the jumping area, they open the door 9*a* by pushing or pulling it so that it rotates inwards towards the mat 5. This bends the resilient door member 10*a* away from the dosed position, and spring energy is stored in the resilient door member 10*a* . The user then enters or exits the jumping area. Depending on where the door is pushed, it will bend or twist down either to the left or to the right. Once door 9*a* is released, the resilient door member 10*a* will unbend and release the stored spring energy, and the door will return to the closed position.

Figure 3B:
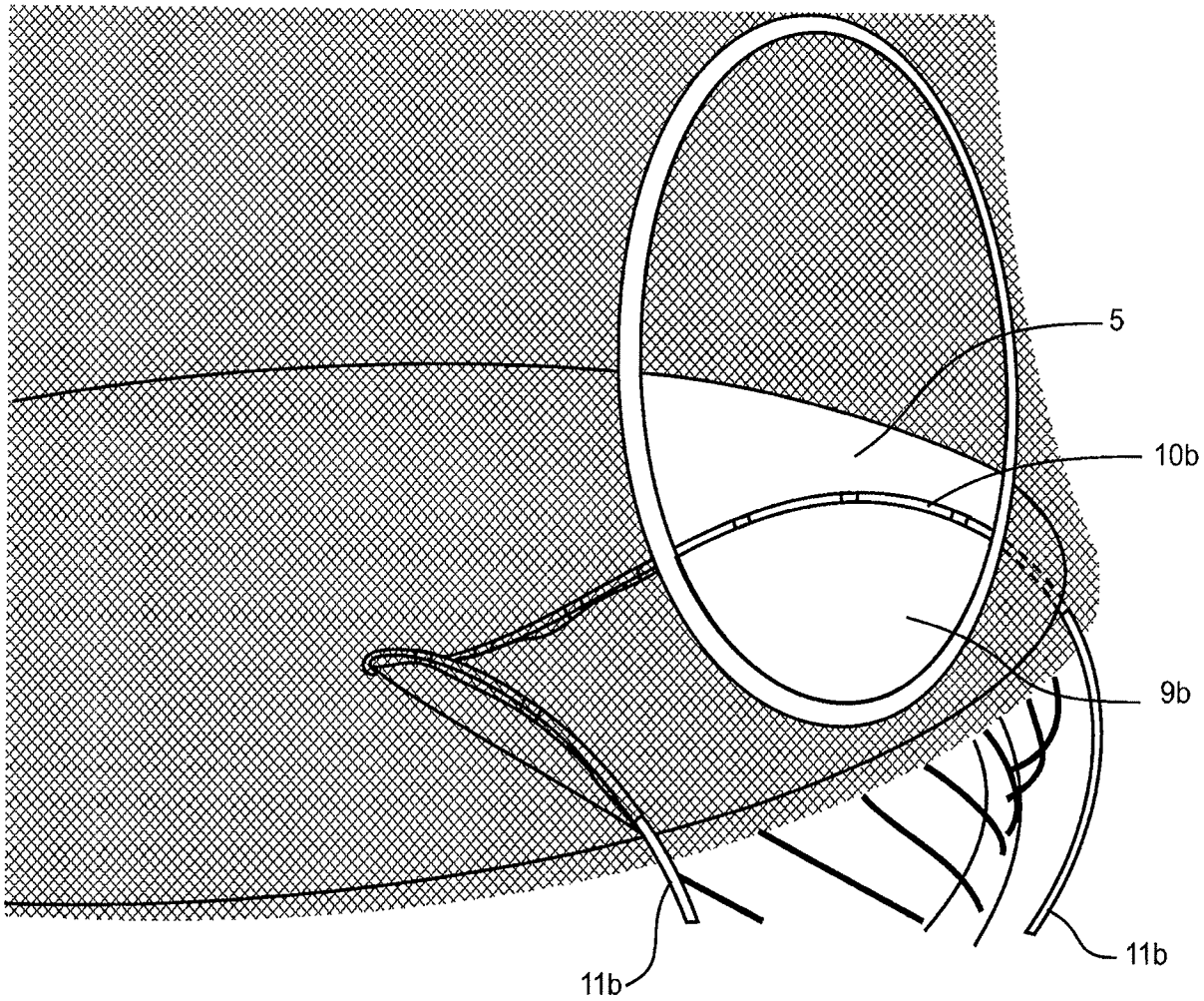
FIGS. 3*b* shows a variation of the door system of FIG. 3*a*, for closing an aperture such as the one shown in FIG. 2, the door panel pivoting around the lower edge.

A variant of the bottom levered door system of FIG. 3*a* is shown in FIG. 3*b*, which shows the door when open ie pushed down onto the mat. The two ends 11*b* of the resilient door member 10*b* extend substantially directly downwards past the base of the door 9*a* and past the edge of the mat 5. The ends 11*b* extend directly downwards, and are most preferably connected to the frame 4. However, the ends 11*b* could be connected to any other substantially rigid part of the trampoline structure. Fitting the two free ends 11*b* to the frame 4 involves slightly bending the lower portion of the resilient door member 10*b* so that the two free ends 11*b* point inwards towards the frame, and the lower part of the main body is bowed outwards away from the mat 5. This adds tension so that as the member 10*b* attempts to return to its original shape, it will press itself, and the door 9*b,* outwards against the enclosure 2.

When a user wishes to enter or exit the jumping area, they open the door 9*b* by pushing or pulling it so that it rotates inwards towards the mat 5 (to the position shown in FIG. 3*b*). This bends the resilient door member 10*b* away from the closed position, and spring energy is stored in the resilient door member 10*b* . The user then enters or exits the jumping area. In this variant, the door opens directly towards the mat, without necessarily twisting to the left or right side. Once door is released, the resilient door member lob will unbend and release the stored spring energy, and the door will return to the closed position.

For both variants, it is most preferred that the door is on the inside of the enclosure wall, and that the door 9*a* or 9*b* is sized to overlap the edges of the aperture 7 so that it is held against the enclosure and the edge of the aperture. However, in alternative forms the door could be located on the outside of the enclosure.

Double Door

Figure 4A:
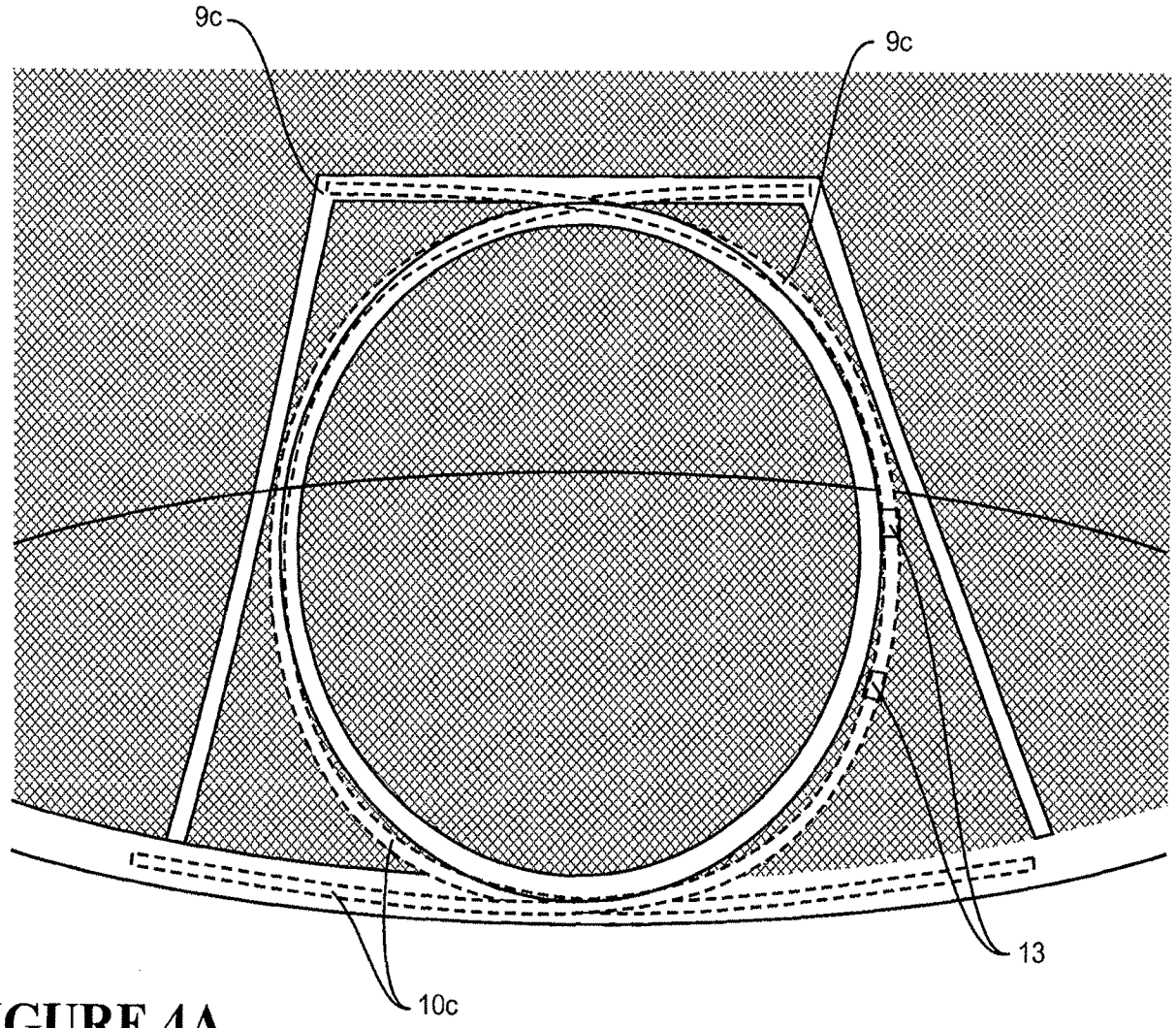
FIG. 4*a* shows a second preferred form of door system for closing an aperture such as the one shown in FIG. 2, the door system having a pair of overlapping doors located one on each side of the aperture, each door having an associated resilient member which acts as a self-closing mechanism to bias the door panel towards a closed position, the door system shown in the closed position.
Figure 4B:
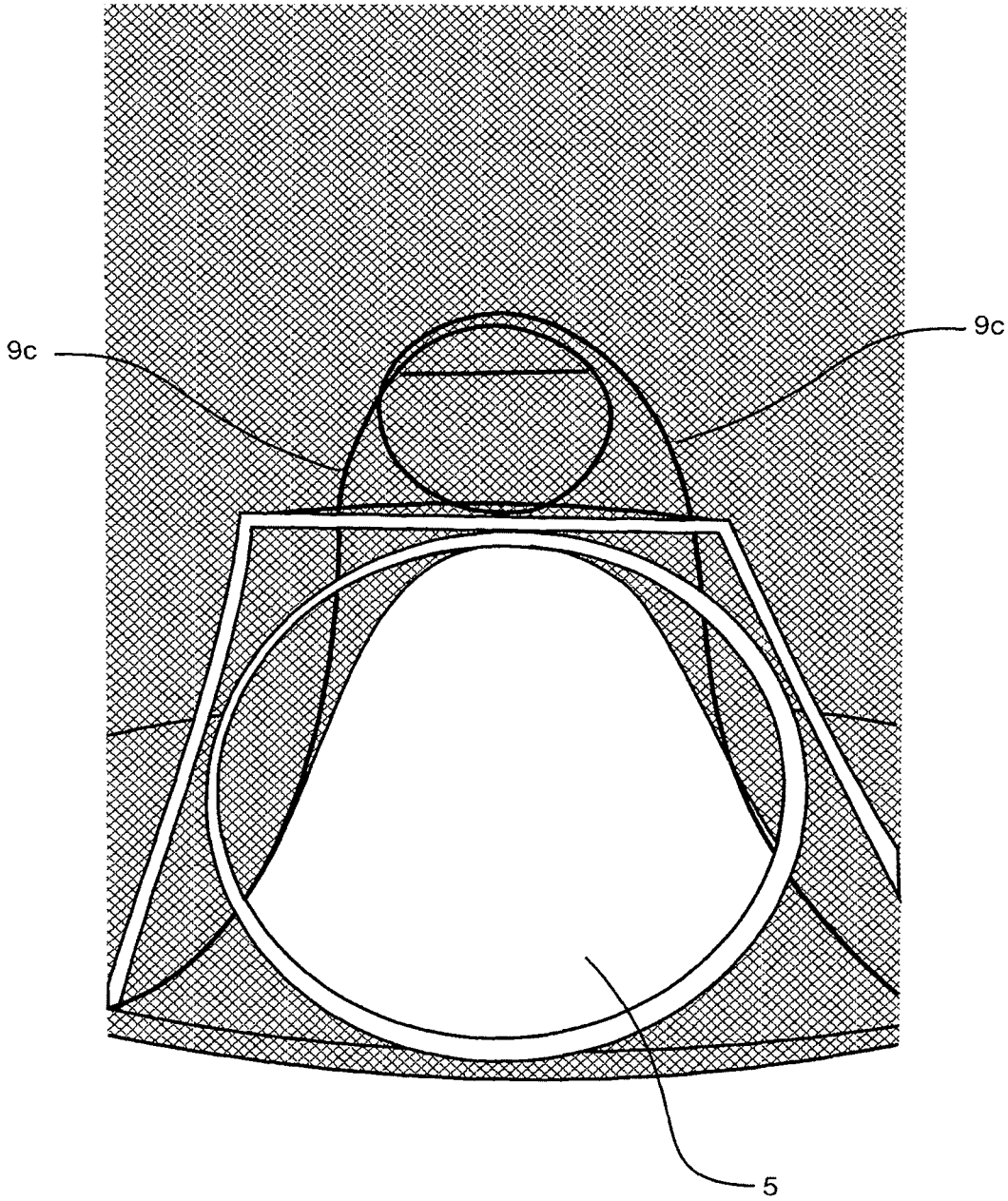
FIG. 4*b* shows the second preferred form of door system of FIG. 4*a* with the doors in the open position, the doors twisted over themselves to form a loop above the top of the aperture.

In the form shown in FIGS. 4*a* and 4*b* the enclosure 2 and enclosure aperture 7 are as described above. The 'double door' door system has two, or a pair of, overlapping doors, each of which are shown as doors 9*c* in FIG. 4. One of the doors is located generally to the left of the aperture, and one to the right. Each door has generally a 'D' shape when viewed from outside the enclosure, with the right-hand one of the pair reversed, so that the 'ID' shape is reversed or backwards when viewed from outside the enclosure. Each of the doors has a curved main body (this is inclusive of a short, straight horizontal section at the top and a longer straight horizontal section at the bottom) and a sloping straight back to the 'D' shape, with the bottom corner further away from the aperture than the top corner of the back of the 'D'. The short horizontal section at the top is generally aligned horizontally and tangential to the circular door aperture. The doors are sewn to the enclosure along the sloping part of the 'D' and for a small distance at the top—generally to around the point at which the tangential line of the top of the door would contact the circular aperture. The main body of each door is formed from the same netting material as the enclosure. Each door has a resilient door member 10*c* associated with it. The resilient door member 10*c* is similar to the member 10*a* described above, Each resilient door member 10*c* is fixed to edge of its associated door with, preferably, a number of webbing loops 13 around the curved section of the 'D' (preferably including the short horizontal section at the top and the longer section at the bottom), but could be fitted with a single loop or pocket that extends around, or close to, the perimeter or curved section of the 'D'.

To access the trampoline a user puts his or her hand or hands under the bottom edge of the doors and lifts. When lifted up the doors 9*c* twist over themselves and form a small loop above the top of the aperture. This action bends the rods or resilient door members 10*c* and puts them in tension (adds spring energy). When released the doors flick back down to cover the aperture. In a similar manner to that outlined above for the bottom levered door, when in the closed position, the rods are slightly bent in tension to follow the outside curve of the circular mat , and the spring energy in the rods will hold the doors against the enclosure to maintain the doors in the closed position.

Sloped Hinge

Figure 5:
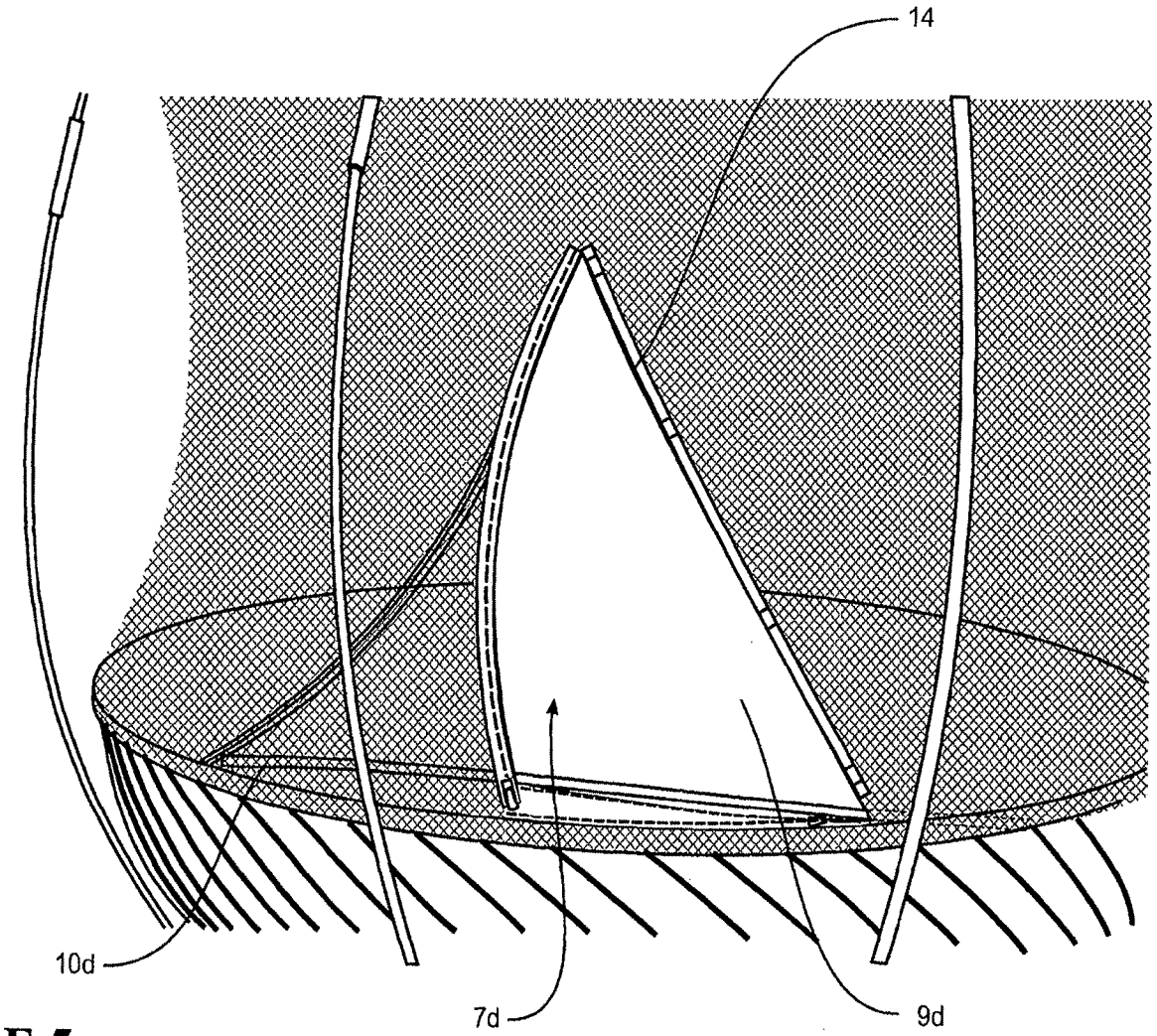
FIG. 5 shows a third preferred form of door system, the enclosure aperture in this embodiment being triangular or sail-shaped with one straight, sloped edge, the door panel having a triangular shape and overlapping the aperture on the inside of the aperture, with one edge of the door congruent with and fixed to the straight sloped edge of the aperture to form a hinge, an associated resilient door member fixed to the bottom edge of the door which runs generally parallel to, and just above, the plane of the jumping mat.

In the embodiment of FIG. 5 the enclosure 2 is generally as described above. However, in this embodiment, the enclosure aperture 7*d* is a triangular or sail-shaped opening in the enclosure, as shown in FIG. 5, with one straight, sloped edge 14. The door 9*d* is a triangular shape and in the preferred embodiment is made from the same material as the mat. As above, the door is larger than the aperture 7*d* so as to overlap on the inside, with one edge of the door congruent with the straight sloped edge of the aperture described above. The door 9*d* is fixed to the enclosure along the congruent edge to form a hinge. A rod or resilient door member 10*d* is fixed to the bottom edge of the door, which is generally parallel to, and just above, the plane of the mat, with the resilient door member 10*d* extending all the way along the lower edge of the door and slightly beyond the corner of the door where the bottom edge of the door meets the hinge edge. The rod is fixed to the bottom edge of the door by at least one and preferably a number of loops or pockets along or close to the bottom edge of the door. The extending end of the rod is preferably held in place on the trampoline by similar mechanism. A user opens the door towards the inside of the trampoline by pushing on the door to pivot the door around the hinge. This adds spring energy to the rod along the bottom edge, and when released, the door will therefore return to the closed position. In the preferred embodiment, the door member 10*d* is a straight rod. In the most preferred embodiment, the edge of the trampoline enclosure is slightly curved, as the mat is circular. Therefore when the straight rod 10*d* is held in position against the edge of the mat by the loops or pocket on the bottom of the door and along the edge of the enclosure, the rod 10*d* will be slightly bent and therefore in tension, helping to hold the door closed. However, it should be noted that this configuration is not a required configuration.

Door Lock

Optionally the door or doors can be fitted with a door lock. In the preferred embodiment the door lock consists of a plastic ball that is preferably attached to the enclosure, and most preferably to the perimeter of the aperture around the reinforcement which is located around the edge of the aperture, via a short length of line or similar. The plastic ball corresponds to a slot in the door. To hold or 'lock' the door closed, the plastic ball is pushed through the slot. When the door is pulled or pushed, the line attaching the ball to the enclosure is pulled to one end of the slot. At the same time, the slot is pulled closed by the tension generated. This prevents the ball from being released, and thus the door is held closed.

The foregoing description of the invention includes preferred forms thereof. Modifications may be made thereto without departing from the scope of the invention, as defined in the accompanying claims.

The invention claimed is:

1. A trampoline system comprising:

a trampoline, having a flexible rebounding mat, a frame, adapted to hold the flexible rebounding mat in tension in a substantially horizontal plane above the frame, an enclosure formed from a barrier of a flexible material, having a lower peripheral part coupled directly or indirectly to the flexible rebounding mat, a plurality of generally upright enclosure support members connected to the frame and extending upwards from the frame around the flexible rebounding mat, the enclosure connected to the plurality of generally upright enclosure support members so as to surround the flexible rebounding mat above the flexible rebounding mat and extend around the flexible rebounding mat, the enclosure having, or being connected to the flexible rebounding mat so as to form an opening for ingress and egress, the trampoline system further having a door system comprising:

a door panel, sized and shaped to at least partly cover or close the opening, and, a resilient member attached to and connecting between the door panel and the trampoline, wherein the resilient member is attached around an edge of the door panel and comprises a pultruded fibreglass rod with two ends which curve outwards to become substantially parallel to the substantially horizontal plane of the flexible rebounding mat and are fixed to the flexible rebounding mat at an outer peripheral edge of the flexible rebounding mat, so that opening and closing of the door panel causes bending and unbending of the resilient member, unbending of the resilient member releasing stored spring energy in the resilient member, the door panel movable between an open position allowing the ingress and egress, and a closed position where the door panel at least partly covers or closes the opening, the resilient member acts to bias the door panel to the closed position, and to return the door panel to the closed position from the open position.

2. The trampoline system as claimed in claim 1 wherein a base of the door panel is connected to the flexible rebounding mat or the enclosure.

3. A trampoline system comprising:

a trampoline, having a flexible rebounding mat, a frame, adapted to hold the flexible rebounding mat in tension in a substantially horizontal plane above the frame, an enclosure formed from a barrier of a flexible material, having a lower peripheral part coupled directly or indirectly to the flexible rebounding mat, a plurality of generally upright enclosure support members connected to the frame and extending upwards from the frame around the flexible rebounding mat, the enclosure connected to the plurality of generally upright enclosure support members so as to surround the flexible rebounding mat above the flexible rebounding mat and extend around the flexible rebounding mat, the enclosure having, or being connected to the flexible rebounding mat so as to form an opening for ingress and egress, the trampoline system further having a door system comprising:

a door panel, sized and shaped to at least partly cover or close the opening, and a resilient member attached to and connecting between the door panel and the trampoline and attached around an edge of the door panel and comprising two ends which are fixed at or below an outer peripheral edge of the flexible rebounding mat, the door panel movable between a closed position where the door panel at least partly covers or closes the opening, and an open position allowing the ingress and egress by pushing or pulling the door panel so that it rotates inwards towards the flexible rebounding mat, opening and closing of the door panel causing bending and unbending of the resilient member, unbending of the resilient member releasing stored spring energy in the resilient member, so that the resilient member acts to bias the door panel to the closed position, and to return the door panel to the closed position from the open position.

* * * * *